US007832057B2

(12) United States Patent
Hoffman

(10) Patent No.: US 7,832,057 B2
(45) Date of Patent: Nov. 16, 2010

(54) EXTENDABLE MULTI-AXIS DOOR HINGE

(75) Inventor: Lawrence Andrew Hoffman, Portland, OR (US)

(73) Assignee: The Hoffman Group International, Ltd. (VG)

( * ) Notice: Subject to any disclaimer, the term of this patent is extended or adjusted under 35 U.S.C. 154(b) by 337 days.

(21) Appl. No.: 11/868,467

(22) Filed: Oct. 5, 2007

(65) Prior Publication Data

US 2008/0083090 A1 Apr. 10, 2008

Related U.S. Application Data

(60) Provisional application No. 60/828,224, filed on Oct. 5, 2006.

(51) Int. Cl.
*E05D 3/10* (2006.01)

(52) U.S. Cl. ..... 16/367; 16/368; 16/294; 16/366; 16/287; 16/354; 16/369; 49/257; 296/146.11; 296/146.12

(58) Field of Classification Search ..... 16/367, 16/368, 294, 366, 287, 354, 369; 296/146.11, 296/146.12; 49/257, 254, 258, 255
See application file for complete search history.

(56) References Cited

U.S. PATENT DOCUMENTS

| | | | | |
|---|---|---|---|---|
| 1,224,036 | A | 4/1917 | Sutton | |
| 1,554,161 | A | 9/1925 | Hubbard | |
| 2,200,142 | A | 5/1940 | Witschi | |
| 2,206,739 | A | 7/1940 | Brogren et al. | |
| 2,326,657 | A | 8/1943 | Johnston | |
| 2,947,567 | A * | 8/1960 | Barenyi | 296/146.11 |
| 3,163,883 | A | 1/1965 | Olsson | |
| 5,170,975 | A | 12/1992 | Chadwick | |
| 5,566,030 | A | 10/1996 | Yue | |
| 5,867,872 | A | 2/1999 | Katoh | |
| 6,030,025 | A * | 2/2000 | Kanerva | 296/146.12 |
| 6,163,929 | A | 12/2000 | Bradley | |
| 6,845,547 | B2 * | 1/2005 | Ham | 16/374 |
| 6,994,393 | B2 | 2/2006 | Votruba et al. | |
| 7,007,346 | B2 * | 3/2006 | Hoffman | 16/367 |

(Continued)

FOREIGN PATENT DOCUMENTS

DE 4319662 A1 * 12/1994

(Continued)

OTHER PUBLICATIONS

U.S. Appl. No. 11/716,114, publication 20080216288, file wrapper, Hoffman.

*Primary Examiner*—Victor Batson
*Assistant Examiner*—Jeffrey O'Brien
(74) *Attorney, Agent, or Firm*—Silicon Forest Patent Group; Paul J Fordenbacher, Esq.

(57) ABSTRACT

Embodiments of multi-axis vehicle door hinges are provided that are adapted to facilitate pivotal motion of a vehicle door about a substantially vertical axis of rotation for swing-out rotation, lateral motion of a vehicle door about a substantially horizontal plane, as well as to facilitate pivotal motion of a vehicle door about a substantially horizontal axis of rotation for vertical-lift rotation and providing means for adjusting the opening angle of the hinge in both the horizontal and vertical axis of rotation.

4 Claims, 10 Drawing Sheets

U.S. PATENT DOCUMENTS

| | | | | |
|---|---|---|---|---|
| 7,140,075 | B2 * | 11/2006 | Ham | 16/367 |
| 7,210,200 | B2 * | 5/2007 | Hoffman | 16/367 |
| 2003/0213102 | A1 * | 11/2003 | Ham | 16/374 |
| 2004/0187263 | A1 * | 9/2004 | Hoffman | 16/367 |
| 2004/0244144 | A1 * | 12/2004 | Ham | 16/221 |
| 2005/0022342 | A1 * | 2/2005 | Ham | 16/374 |
| 2005/0166363 | A1 * | 8/2005 | Hoffman | 16/244 |
| 2007/0013208 | A1 * | 1/2007 | Krumholz | 296/146.12 |
| 2007/0214606 | A1 | 9/2007 | Hoffman | |
| 2008/0083089 | A1 | 4/2008 | Hoffman | |
| 2008/0216288 | A1 | 9/2008 | Hoffman | |
| 2009/0013500 | A1 | 1/2009 | Ueyama et al. | |

FOREIGN PATENT DOCUMENTS

| | | | |
|---|---|---|---|
| FR | 2694244 | A1 * | 2/1994 |

* cited by examiner

EXTENDABLE MULTI-AXIS DOOR HINGE

RELATED APPLICATIONS

This application is a non-provisional patent application taking priority to U.S. provisional patent application No. 60/828,224, filed Oct. 5, 2006, incorporated herein in its entirety by reference, and is related to U.S. non-provisional application Ser. No. 11/867,666, filed Oct. 4, 2007, incorporated herein in its entirety by reference, U.S. non-provisional application Ser. No. 11/691,491, filed Mar. 26, 2007, incorporated herein in its entirety by reference, U.S. non-provisional application Ser. No. 11/056,136, now U.S. Pat. No. 7,210,200, filed Feb. 11, 2005, incorporated herein in its entirety by reference, and U.S. non-provisional patent application Ser. No. 10/396,284, now U.S. Pat. No. 7,007,346, filed Mar. 25, 2003, incorporated herein in its entirety by reference.

FIELD

Embodiments presented relate to vehicle door hinges, and more particularly, to multi-axis door hinge components and swing-out vertical-lift door assemblies with independent function characteristics.

BACKGROUND

One aspect of the vehicle that has changed little is the swing-out door. The swing-out door is suspended from the vehicle body using conventional single-axis hinges. Each single-axis hinge comprises two leaves; a stationary leaf that is usually mounted on a forward portion of a doorjamb, and a hinge leaf that is usually mounted on a forward portion of a door edge. Each leaf comprises one or more knuckles which have coaxial through bores. The knuckles of two leaves are interleaved such that the through bores are placed in coaxial alignment. The leaves are rotatably joined together with a hinge pin extending through the bores.

The conventional single-axis hinge permits rotation within one plane. As the door is opened, the rear door edge swings out from the side of the vehicle in a substantially horizontal plane, whereby a space for stepping-in and stepping-out is formed between the rear door edge and the vehicle body. A major issue with swing-out doors is the situation of tight parking spaces with little room for the door to swing open to allow ingress and egress. Also, the potential for damage to an adjacent vehicle is a persistent problem resulting in the inevitable door ding.

Other door opening configurations have been tried, such as sliding, gull wing, and vertical-lift doors. Sliding doors are popular on vans, but not vehicles. The single-axis hinges of the gull wing door are mounted along the upper door edge, the door forming a portion of the roof, and permits rotation of the door above the vehicle; a design made famous by DeLorian Motor Company. The single-axis hinge of the vertical-lift door, which is also known as lambo, scissors, or jack-knife doors, is mounted in the forward upper door corner which permits door rotation substantially within a vertical plane defined by the door; a design made famous by Lamborghini.

The advantages of the vertical-lift door are both functional and aesthetic. Since the rotation of the door is upward and not sideways, as with the common swing-out door, ingress and egress is greatly facilitated in closely-spaced parking situations. The vertical-lift door eliminates the potential of banging the door against an object located to the side of the vehicle. The vertical-lift door also adds a sense of style and luxury to the vehicle.

For the most part, vertical-lift doors have been available only on expensive luxury performance vehicles and vehicles assembled from a kit by the consumer. These vehicles have door and door jam configurations, single-axis hinges, and latching mechanisms specifically designed into the vehicle to permit the door to open vertically.

Many vehicle enthusiasts consider it highly desirable to incorporate exotic features into their ordinary stock vehicles. The vertical-lift door is one such feature that has, for the most part, been out of reach of the aftermarket enthusiast. Retrofitting the conventional door to operate as a vertical-lift door is difficult to impossible due in part to door and vehicle body style. Many vehicle body styles incorporate doors with contoured surfaces that would collide with the vehicle body if opened as a vertical-lift door.

In some vehicle body styles, the bottom edge of the door undercuts the vehicle body and, therefore, would prevent vertical rotation of the door. Other vehicle body styles incorporate roof structures that overhang the top edge of the door, precluding vertical rotation of the door.

These and other issues hinder the availability of aftermarket components that would permit the vehicle enthusiast to retrofit the conventional swing-out door to operate as a vertical-lift door. These issues also hinder the vehicle manufacturers from incorporating vertical-lift doors in vehicles without requiring major redesign of the current vehicle body styles which may or may not be aesthetically pleasing to the customer.

It would, therefore, be highly desirable to have components and assemblies that would provide vehicle manufacturers and aftermarket enthusiasts the ability to incorporate the motion of the vertical-lift door in currently designed vehicles without major modification to the vehicle body or door structures.

DETAILED DESCRIPTION

In the following detailed description, reference is made to the accompanying drawings which form a part hereof wherein like numerals designate like parts throughout, and in which is shown by way of illustration specific embodiments in which they may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

In the following detailed description, various terms are used to define various elements of a hinge. Other terms are used in the art to reference the same hinge element. Therefore, it is understood that the present invention is not to be limited by the use of a particular term used in reference to a particular hinge element. The following terminology is used throughout the description: a conventional hinge comprises two leaves, namely a stationary leaf and a hinge leaf, which pivot on a single axis of rotation; a leaf consists generally of a mounting portion, such as, but not limited to, a mounting plate, and one or more knuckles; a knuckle comprises an element, generally circular, having a bore adapted to accept a hinge pin, the knuckle depending from a mounting portion of a leaf; a notch is a space between two adjacent knuckles on one leaf into which a knuckle from a second leaf is positioned and interleaved; a stationary leaf is the leaf which is attached to a non-moving structure, such as a door frame; a hinge leaf is a leaf which is attached to a door; and a hinge pin is generally a rod adapted to pass through the bore of the interleaved knuckles of two leaves to join the leaves together.

Embodiments of multi-axis vehicle door hinges are provided that are adapted to facilitate pivotal motion of a vehicle door about a substantially vertical axis of rotation for swing-out rotation, lateral motion of a vehicle door about a substantially horizontal plane, as well as to facilitate pivotal motion of a vehicle door about a substantially horizontal axis of rotation for vertical-lift rotation. Other embodiments of multi-axis vehicle door hinges are provided with means for adjusting the opening angle of the hinge in both the horizontal and vertical axis of rotation.

Figure 1A:
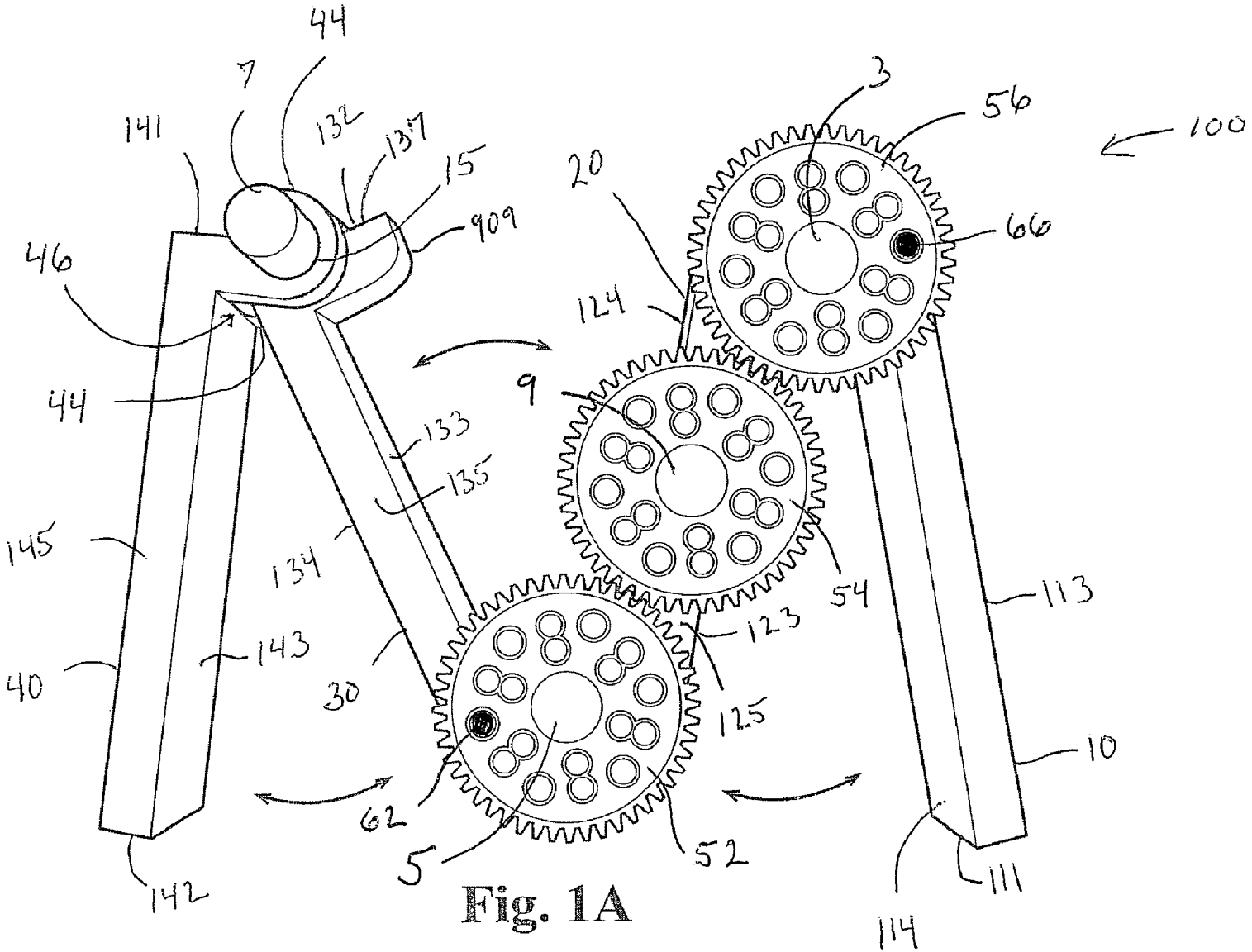
FIGS. 1A and 1B are top and bottom views of an extendable multi-axis door hinge in a partially open orientation, in accordance with an embodiment.
Figure 1B:
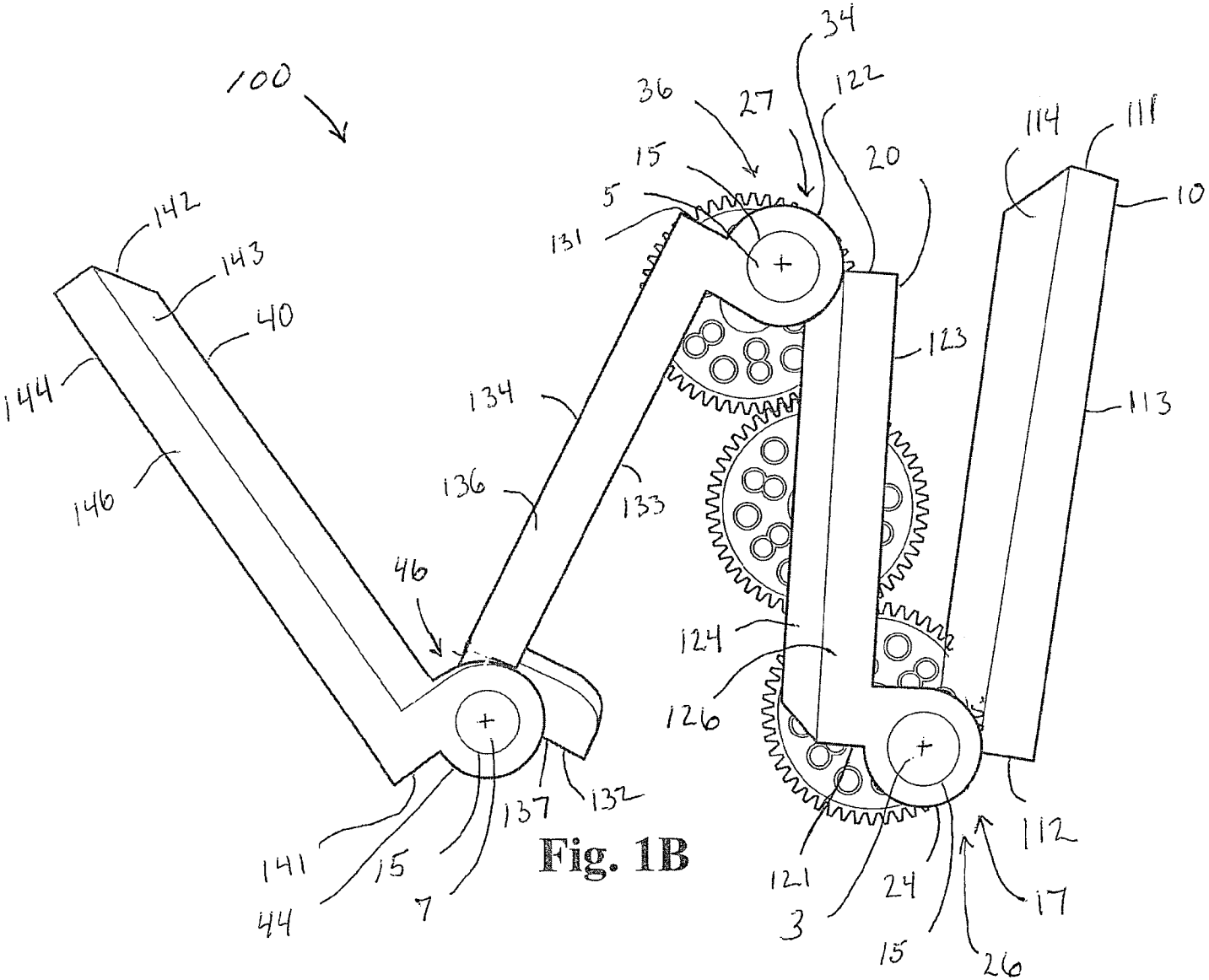
Figure 1C:
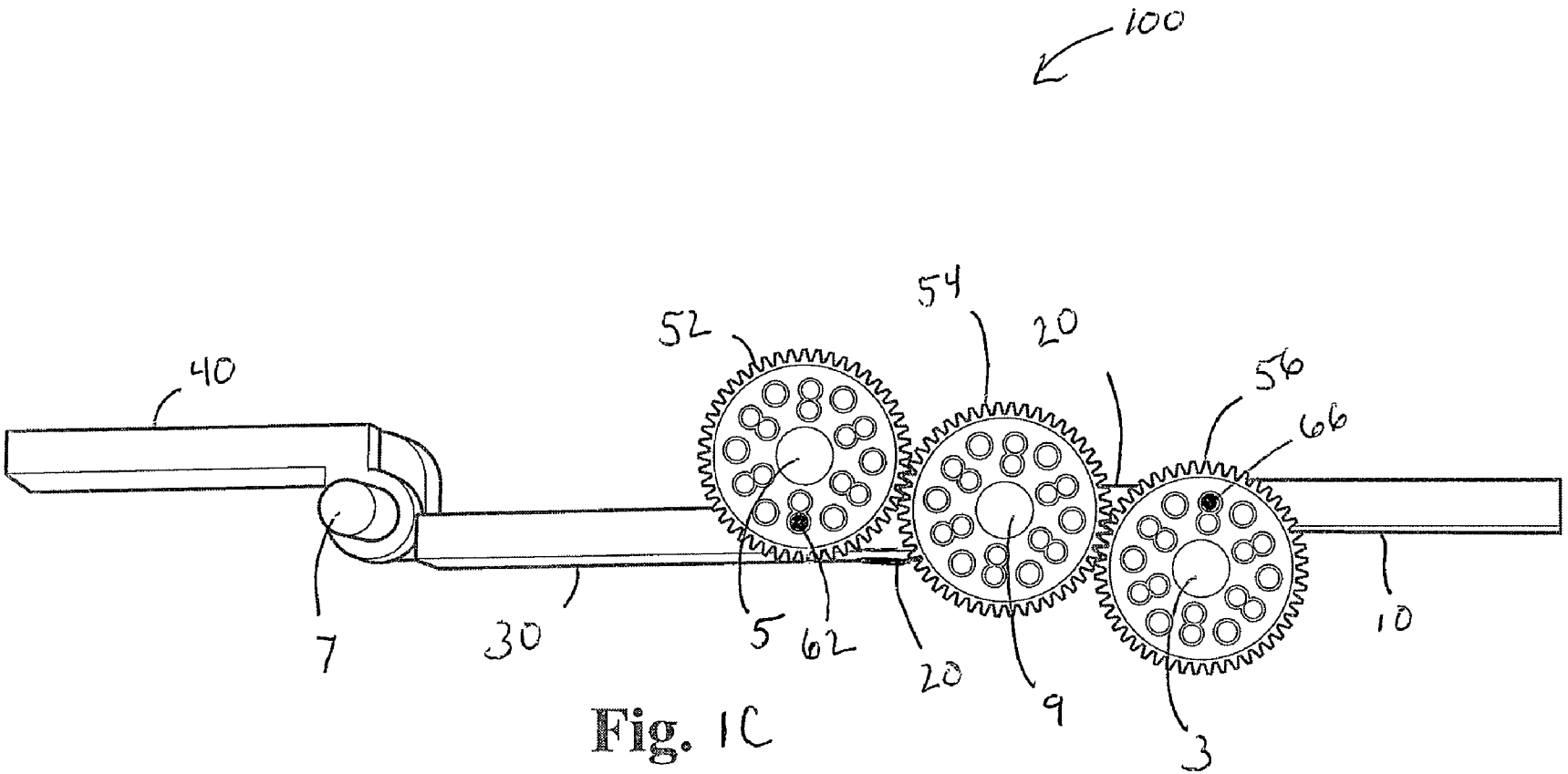
FIG. 1C is a top view of the multi-axis automobile door hinge of the embodiment of FIG. 1A in a fully open extended orientation.

FIGS. 1A and 1B are top and bottom views of an extendable multi-axis door hinge 100 in a partially open orientation, in accordance with an embodiment. FIG. 1C is a top view of the multi-axis automobile door hinge 100 in a fully open extended orientation. The extendable multi-axis door hinge 100 comprises a first leaf 10, second leaf 20, third leaf 30, and fourth leaf 40.

The first leaf 10 comprises a first leaf first end 111, a first leaf second end 112 opposite the first leaf first end 111, a first leaf first side 113, and a first leaf second side 114 opposite the first leaf first side 113. Depending from the first leaf second side 114 adjacent the first leaf second end 112 is a first leaf knuckle 17 (see also FIG. 4B for similar construction). The first leaf knuckle 17 has a generally cylindrical shape with a bore 15 (not shown) there through. The axis of the bore 15 extends substantially parallel to the first leaf second end 112.

The second leaf 20 comprises a second leaf first end 121, a second leaf second end 122 opposite the second leaf first end 121, a second leaf first side 123, a second leaf second side 124 opposite the second leaf first side 123, a second leaf first edge 125, and a second leaf second edge 126 opposite the second leaf first edge 125. Two spaced-apart second leaf first knuckles 24 depend from the second leaf first side 123 adjacent the second leaf first end 121 defining a second leaf notch 26 therebetween (see also FIG. 4B for similar construction). The second leaf first knuckles 24 have a generally cylindrical shape, each with a bore 15 therethrough. The bores 15 are substantially coaxial and extend substantially parallel to the second leaf first end 121. The first leaf knuckle 17 of the first leaf 10 is adapted to be interleaved within the second notch 26 of the second leaf 20 with the axes of the bores 15 in substantially coaxial alignment therewith. A pivot pin 3 extending through the respective bores pivotally couples the first leaf 10 with the second leaf 20.

A second leaf second knuckle 27 depends from the second leaf second side 124 and adjacent to the second leaf second end 122. The second leaf second knuckle 27 has a generally cylindrical shape with a bore 15 therethrough. The axis of the bore 15 extends substantially parallel with the second leaf second end 122. The second leaf second knuckle 27 of the second leaf 20 is adapted to be interleaved within a third leaf notch 36 of the third leaf 30 with the axes of the bores 15 in substantially coaxial alignment, as discussed below.

The third leaf 30 comprises a third leaf first end 131, a third leaf second end 132 opposite the third leaf first end 131, a third leaf first side 133, a third leaf second side 134 opposite the third leaf first side 133, a third leaf first edge 135, and a third leaf second edge 136 opposite the third leaf first edge 135. Two spaced-apart third leaf first knuckles 34 depend from the third leaf first side 133 adjacent the third leaf first end 131 defining a third leaf notch 36 therebetween. The third leaf first knuckles 34 have a generally cylindrical shape, each with a bore 15 therethrough. The bores 15 are substantially coaxial and extend substantially parallel to the third leaf first end 131. The second leaf knuckle 27 of the second leaf 20 is adapted to be interleaved within the third leaf notch 36 of the third leaf 30 with the axes of the bores 15 in substantially coaxial alignment therewith. A pivot pin 5 extending through the respective bores pivotally couples the second leaf 20 with the third leaf 30.

A third leaf second knuckle 37 depends from the third leaf second end 132. The third leaf second knuckle 37 defines a bore 15 therethrough. The axis of the bore 15 extends substantially parallel with the third leaf second end 132. The third leaf second knuckle 37 of the third leaf 30 is adapted to be interleaved within a fourth leaf notch 46 of the fourth leaf 40 with the axes of the bores 15 in substantially coaxial alignment, as discussed below.

The fourth leaf 40 comprises a fourth leaf first end 141, a fourth leaf second end 142 opposite the fourth leaf first end 141, a fourth leaf first side 143, a fourth leaf second side 144 opposite the fourth leaf first side 143, a fourth leaf first edge 145, and a fourth leaf second edge 146 opposite the fourth leaf first edge 125. Two spaced-apart fourth leaf first knuckles 44 depend from the fourth leaf first side 143 adjacent the fourth leaf first end 141 defining a fourth leaf notch 46 therebetween. The fourth leaf first knuckles 44 define a bore 15 therethrough. The bores 15 are substantially coaxial and extend substantially parallel to the fourth leaf first end 141. The third leaf knuckle 37 of the third leaf 30 is adapted to be interleaved within the fourth leaf notch 46 of the fourth leaf 40 with the axes of the bores 15 in substantially coaxial alignment therewith. A pivot pin 7 extending through the respective bores pivotally couples the third leaf 30 with the fourth leaf 40.

Each leaf comprises knuckles and notches as described above but it is understood that other pivoting structures and combinations may be used for substantially the same purpose. It is appreciated that the embodiments of the multi-axis vehicle door hinges will operate in substantially the same manner where the arrangement of the knuckles and notches are transposed on respective leaves. Also, it is appreciated that the number of knuckles and notches may vary without deviating from the basic operation and function of the multi-axis vehicle door hinge 200.

It is appreciated that the shape of the knuckles and notches may be varied while retaining the functionality provided by the multi-axis vehicle door hinge. For example, but not limited thereto, the knuckle is in the form of one or more depending flanges each having an aperture substantially coaxial with the other, each flange aperture being coaxial with and placed in sliding pivoting engagement with a corresponding flange aperture of a corresponding leaf.

In accordance with an embodiment, the third leaf 30 and the fourth leaf 40 pivot in the conventional manner. The first leaf 10, second leaf 20 and third leaf 30 pivot in a predetermined controlled manner independent of the relative movement between the third leaf 30 and the fourth leaf 40.

The extendable multi-axis door hinge 100 further comprises a first gear 52, a second gear 54, and a third gear 56. The first gear 52 is pivotally coupled with the second pivot pin 5 that pivotally couples the second leaf 20 and the third leaf 30. The first gear 52 is rigidly coupled to the third leaf 30 by a coupling pin 62 such that when the first gear 52 rotates, the third leaf 30 will pivot about pivot pin 5. The third gear 56 is pivotally coupled with the first pin 3 that pivotally couples the first leaf 10 and the second leaf 20. The third gear 56 is rigidly coupled to the first leaf 10 by a coupling pin 66 such that when the third gear 56 rotates, the first leaf 10 will pivot about pivot pin 3. The second gear 54 is in operative engagement with and between both the first gear 52 and the third gear 56 such that when the first gear 52 rotates, the third gear 56 rotates in the same direction. When the first leaf end 111 is moved away from the second leaf 20, the first gear 52 drives the second gear 54 which drives the third gear 56 so as to move the third leaf second end 132 away from the second leaf 20.

In another embodiment, the knuckle 17 of the first leaf 10 is rigidly coupled to the pivot pin 3 which itself is rigidly coupled to the third gear 56, such that when the third gear 56 rotates, the pivot pin 3 also rotates, rotating the first leaf 10 as well. Also, the knuckle 137 of the third leaf 30 is rigidly coupled to the pivot pin 7 which itself is rigidly coupled to the first gear 52, such that when the first gear 52 rotates, the pivot pin 7 also rotates, rotating the third leaf 30 as well. The second gear 54 is in operative engagement with and between both the first gear 52 and the third gear 56 such that when the first gear 52 rotates, the third gear 56 rotates in the same direction. When the first leaf end 111 is moved away from the second leaf 20, the first gear 52 drives the second gear 54 which drives the third gear 56 so as to move the third leaf second end 132 away from the second leaf 20.

Thus, the pivot action of the first leaf 10, second leaf 20, and the third leaf 30 is controlled by the engagement of the first gear 52, second gear 54 and third gear 56. Pivotal movement of the first leaf 10 away from the second leaf 20 causes the second leaf 20 to pivot relative to the first leaf 10 and third leaf 30 in a controlled predetermined manner.

The relative movement of the first leaf 10, second leaf 20, and third leaf 30 allows a structure coupled to the fourth leaf 40, such as, but not limited to, a door, to move substantially laterally away from the first leaf 10. This lateral movement allows for more clearance between a structure coupled to the first leaf 10 and a structure coupled to the fourth leaf 40. The pivoting motion of the third leaf 30 and the fourth leaf 40 is that of a conventional hinge, allowing conventional swing motion in dependent of the movement of the first leaf 10 and the second leaf 20.

It is understood that additional gears could be used to couple the second leaf 20 to the fourth leaf 40, such that the first leaf 10, second leaf 20, third leaf 30, and fourth leaf 40 all move in cooperative engagement controlled by the gears.

In accordance with other embodiments of the present invention, one of the first, second and third gears is driven into rotation by a motor.

In accordance with other embodiments of the present invention, one or more of the first, second and third gears has a rotation limiter element adapted to stop the rotation of the gears, and therefore the relative movement of the first, second and third leaves. By way of example, but not limited thereto, the third gear may have a gear tooth configuration that prevents engagement with the teeth of the second gear after rotation about a predetermined rotation angle, so as to prevent over-extension of the first, second and third leaves.

In accordance with other embodiments of the present invention, one or more of the first, second and third leaves has a rotation limiter element adapted to stop the pivot of the respective leaves. By way of example, but not limited thereto, as shown in FIG. 1A, the third leaf may have a rotation limiter element 909 depending therefrom and adapted to engage the fourth leaf 40 after rotation about a predetermined rotation angle in the open orientation, so as to prevent over-extension of the third leaf 30. Additionally, the rotation limiter element 909 depending from the third leaf 30 is adapted to engage the second leaf 20 after rotation about a predetermined rotation angle in the closed orientation, so as to prevent under-extension of the second leaf 20.

Figure 2A:
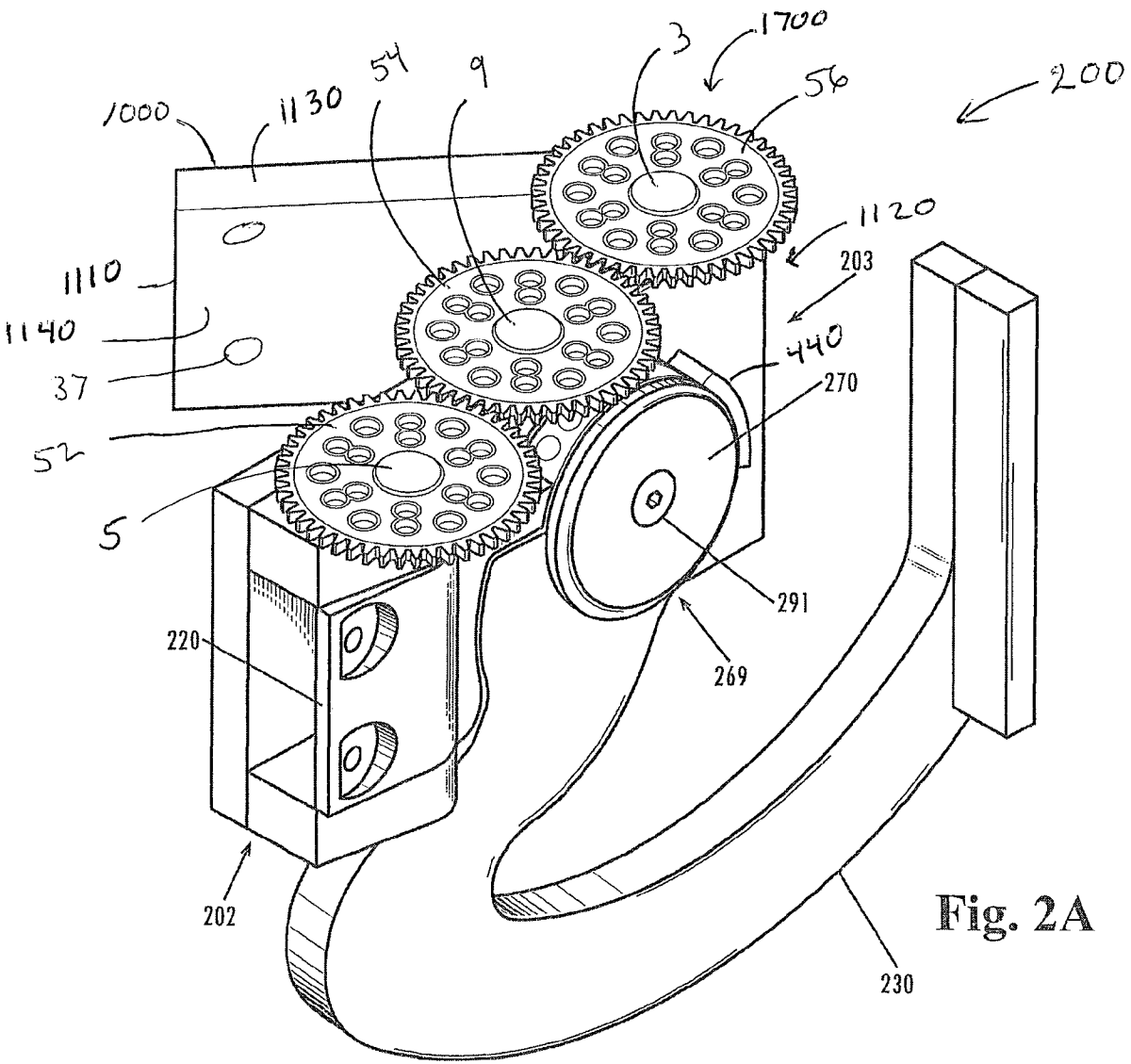
FIGS. 2A-2B are perspective and exploded views of a multi-axis vehicle door hinge in a partially open position and exploded view, respectively, in accordance with an embodiment.
Figure 2B:
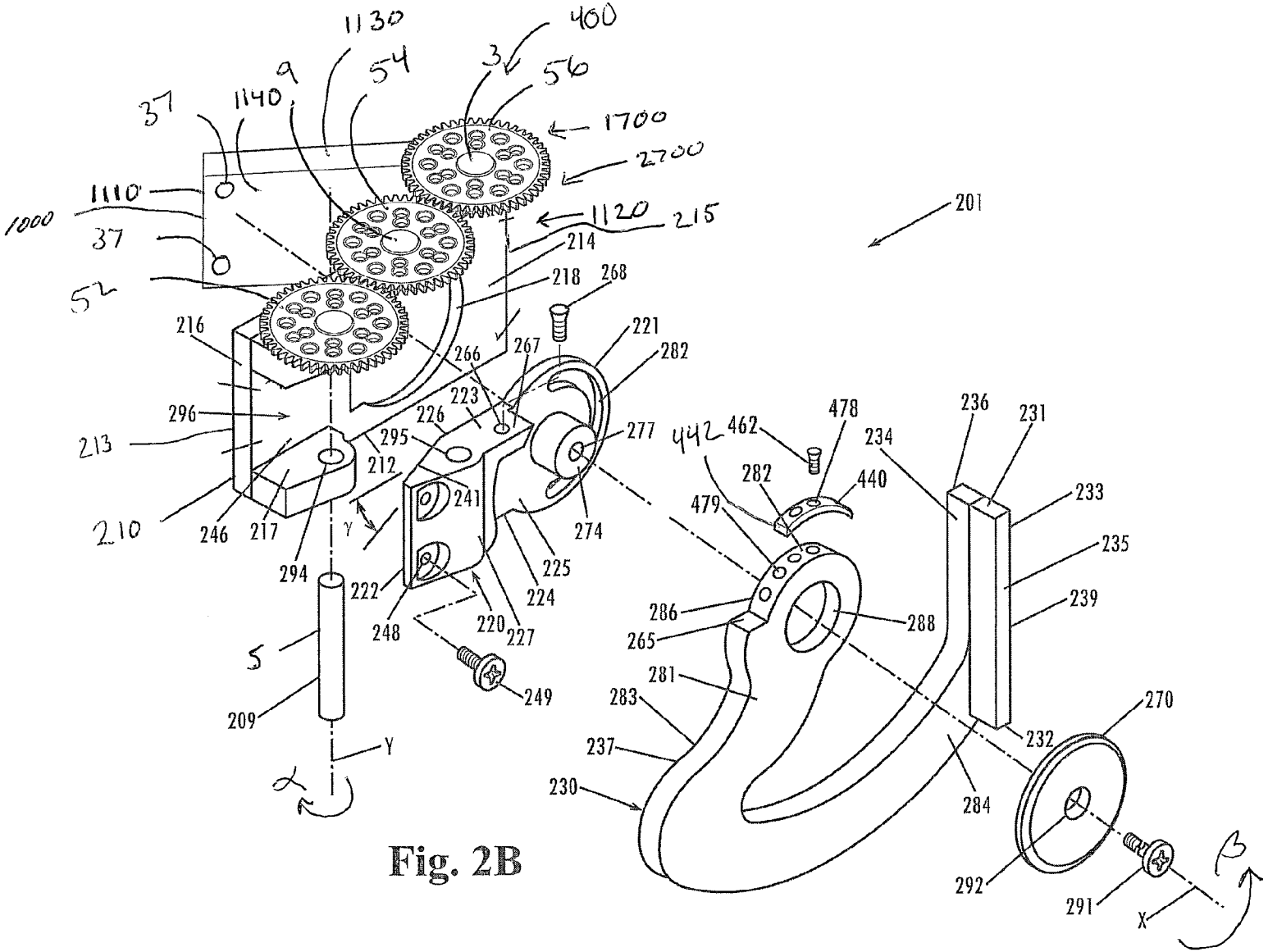

FIGS. 2A-2B are perspective and exploded views of a multi-axis vehicle door hinge 200 in a partially open position and exploded view, respectively, in accordance with an embodiment. The multi-axis vehicle door hinge 200 comprises a first leaf 210, a second leaf 220, a third leaf 230, and a fourth leaf 1000. The first leaf 210 and the second leaf 220 are coupled with a hinge pin 5 defining a swing-out hinge 202 that provides rotation in a substantially horizontal plane about a substantially vertical axis of rotation Y. The second leaf 220 and the third leaf 230 are coupled about a lift bearing 269 defining a vertical-lift hinge 203 that provides rotation in a substantially vertical plane about a substantially horizontal axis X of rotation. The fourth leaf 1000 and the first leaf 210 are pivotally coupled with a hinge pin 3. The multi-axis vehicle door hinge 200 further comprises a first gear 52, second gear 54 and third gear 56 in corporative engagement with the fourth leaf 1000 and the first leaf 210 so as to provide the controlled substantially lateral movement as provided by the embodiment of FIGS. 1A-1C.

The multi-axis vehicle door hinge 200, therefore, provides translation about a plane orthogonal to the axis of pivot pin 5 and rotation in a substantially horizontal plane, noted as swing angle .alpha., and independent rotation in a substantially vertical plane, noted as lift angle .beta., separately, and in combination, to suit a particular purpose.

Figure 3:
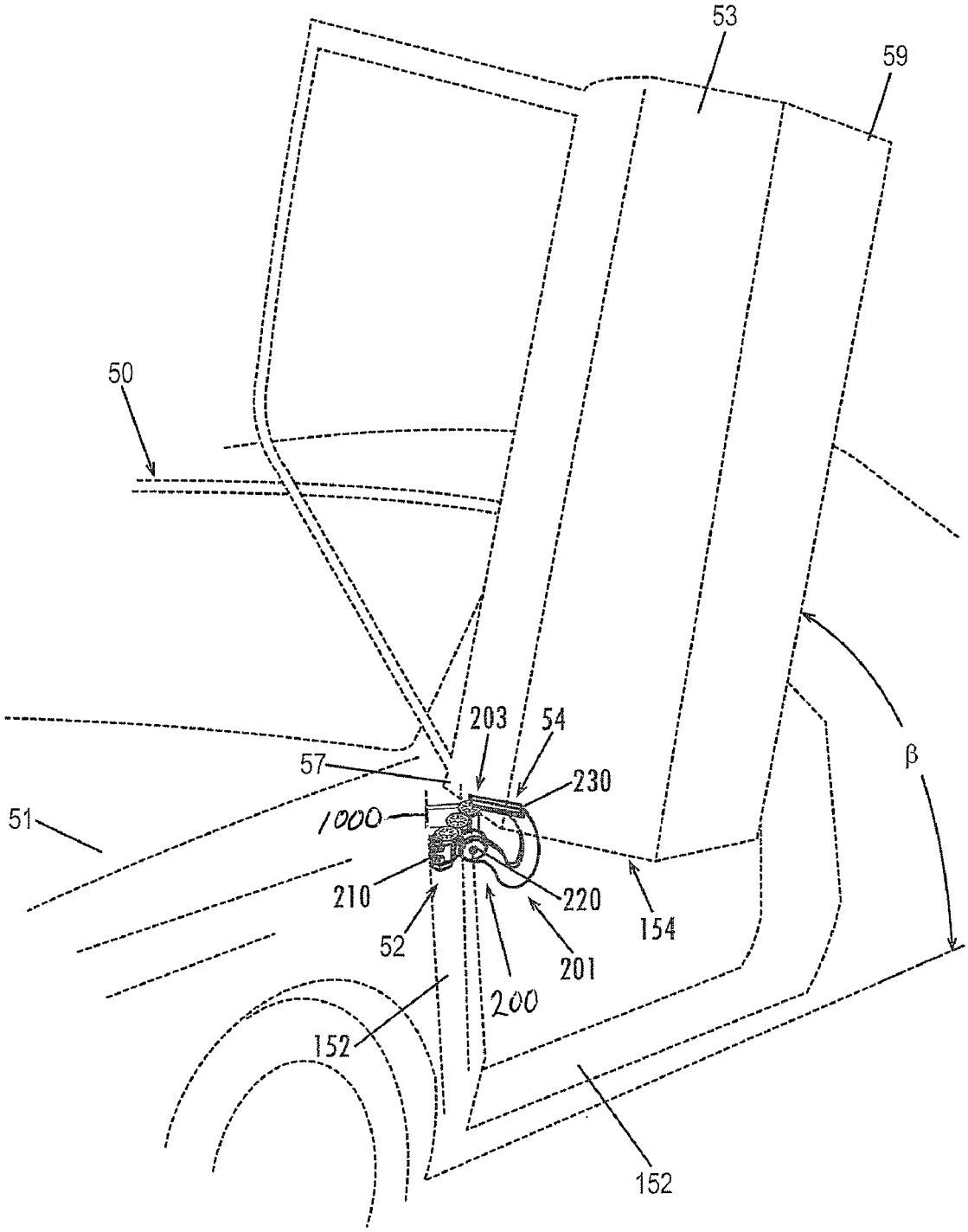
FIG. 3 is a front perspective view of an application of the multi-axis vehicle door hinge as used to provide a door of a vehicle with a combination of swing open and lateral out movement, and independent vertical-lift operation, in accordance with an embodiment.

FIG. 3 is a front perspective view of an application of the multi-axis vehicle door hinge 200 as used to provide a door of a vehicle with a combination of swing open and lateral out movement, and independent vertical-lift operation, in accordance with an embodiment. The multi-axis vehicle door hinge 200 is adapted to provide a door 53 of a vehicle 50 with lateral and swing-out and vertical-lift operational characteristics, in accordance with an embodiment. This movement allows, among other motions, for the vehicle door to be moved out of the door frame laterally and/or swung open at an angle to the door opening, then swung back parallel with the door opening while remaining spaced apart from the door opening, and vertically lifted about a plane parallel with the door opening.

The fourth leaf 1000 is adapted to be coupled to a hinge mount body surface 52 of a doorjamb 152 as shown in FIG. 3. The fourth leaf 1000, therefore, is adapted to function as a stationary leaf. The third leaf 230 is adapted to be coupled to a hinge mount door surface 54 of a door edge 154, to function as a hinge leaf. The fourth leaf 1000 is pivotally coupled about a vertical axis of rotation to the first leaf 210. The second leaf 220 is pivotally coupled about a vertical axis of rotation to the first leaf 210, and pivotally coupled about a horizontal axis of rotation to the third leaf 230 which provides rotation of the door 53 within a substantially horizontal and substantially vertical plane, respectively, as well as lateral motion.

The multi-axis vehicle door hinge 200, as will be discussed below, provides a combination of lateral-out, swing-out, and vertical-lift motion for, among other things, the retrofitting of a conventional single-axis swing-out vehicle door for lateral-out, swing-out, and vertical-lift operation. In an embodiment, the door 53 is adapted to open from a closed position in the conventional swing-out rotation about the swing-out hinge 202 within a substantially horizontal plane. At a predetermined angle .alpha. of the door 53 to the vehicle body 51, the door 53 is adapted to rotate upward about the vertical-lift hinge 203 within a substantially vertical plane to a predetermined lift angle .beta. The door 53 may be moved laterally out from the door frame. The door 53 is adapted to close by lowering the door 53 to the substantially horizontal orientation and swung-in in the conventional manner as well as lateral motion closed.

Referring again to FIGS. 2A-2B, each leaf is discussed in turn below. The fourth leaf 1000 is substantially similar to the first leaf 10 of the embodiment of FIGS. 1A-1B. The fourth leaf 1000 comprises a fourth leaf first end 1110, a fourth leaf second end 1120 opposite the fourth leaf first end 1110, a fourth leaf first side 1130, a fourth leaf second side 1140 opposite the fourth leaf first side 1130, a fourth leaf first edge 1150, and a fourth leaf second edge 1160 opposite the fourth leaf first edge 1350. Depending from the fourth leaf second side 1140 adjacent the fourth leaf second end 1120 is a fourth leaf knuckle 1700. The fourth leaf knuckle 1700 has a generally cylindrical shape with a bore 15 (not shown) there through. The axis of the bore 15 extends substantially parallel to the fourth leaf second end 1120.

The first leaf 210 comprises a first leaf first edge 211, a first leaf second edge 212, a first leaf first side 213, a first leaf second side 214, a first leaf third edge 215, and a first leaf fourth edge 216. Depending from the first leaf first side 213 adjacent the first leaf third edge 215 are two spaced apart second swing knuckles (not shown) defining a swing notch (not shown) there-between, substantially as shown in the embodiment of the second leaf 20 in FIG. 1B. The second swing knuckles (not shown) each define a second swing knuckle bore therethrough. The axis of the second swing knuckle bores are in substantially coaxial alignment. The second swing notch is adapted to accept the fourth leaf knuckle 1700 of the fourth leaf 1000.

Depending from the first leaf second side 214 adjacent the first leaf fourth edge 216 are two spaced apart first swing knuckles 217 defining a swing notch 296 there-between. The first swing knuckles 217 each define a first swing knuckle bore 294 therethrough. The axis of the first swing knuckle bores 294 are in substantially coaxial alignment and extend substantially along the vertical axis Y when the first leaf 210 is coupled to a vehicle 50 for a particular purpose. The swing notch 296 is adapted to accept a second swing knuckle 227 of the second leaf 220, as will be discussed below.

The first leaf 210 further comprises a recessed portion 218, depending a predetermined distance into the first leaf second side 214. The recessed portion 218 is adapted to receive a portion of the second leaf 220, as will be described below. In another embodiment, the recessed portion 218 is a through hole depending from the first leaf second side 214 to the first leaf first side 213. In yet another embodiment, the first leaf 210 has no recessed portion as defined above.

Referring again to FIGS. 1A-1C, the second leaf 220 comprises a second leaf first end 221, a second leaf second end 222, a second leaf first edge 223, a second leaf second edge 224, a second leaf first side 225, and a second leaf second side 226. The second leaf second end 222 comprises a second swing knuckle bore 295 depending between the second leaf first edge 223 and the second leaf second edge 224 defining a second swing knuckle 227. The second swing knuckle 227 of the second leaf 220 is adapted to be interleaved within the swing notch 296 of the first leaf 210 with the axis of the first swing knuckle bores 294 and second swing knuckle bore 295 in substantially coaxial alignment, as discussed below.

A lift hub 274 defining a cylindrical shape depends substantially perpendicular from the second leaf first side 225 adjacent the second leaf first end 221 and defining a horizontal axis X substantially transverse to the second swing knuckle bore 295, which is located along the vertical axis Y. The lift hub 274 defines a first half of a lift bearing 269. The lift hub 274 further comprises a threaded bore 277 to receive a fastener 291 therein, as explained further below.

The second leaf second end 222 comprises a bevel portion 241 defined therein. The bevel portion 241 faces the first leaf 210 and prevents rotation of the second leaf 220 greater than a predefined bevel angle .gamma., such as, but not limited to, 20.degree. (degrees), by the impact of the bevel portion 241 with a bevel impact surface 246 on the first leaf second side 214 adjacent the first leaf fourth edge 216. The second leaf second end 222 defines one or more threaded swing-limiting bores 248 extending through to the bevel portion 241. End portions of suitable fasteners 249, such as but not limited to bolts and set screws, adjustably depend beyond the bevel portion 241 to contact the bevel impact surface 246 when the second leaf 220 is at a predetermined swing angle .alpha. to provide adjustability of the extent of the swing angle .alpha. up to the maximum bevel angle .gamma.

In the embodiment of FIG. 1C, the second leaf first end 221 is adapted to be at least partially contained within the recessed portion 218 of the first leaf 210. The second leaf first end 221 defines a semi-circular shape having an axis substantially coaxial with the lift hub 274. Other nesting shapes of the second leaf first end 221 and the recessed portion 218 are anticipated suitable for a particular purpose. The second leaf first end 221 being adapted to be at least partially contained within the recessed portion 218 of the first leaf 210 provides for an extended swing extension when in the closed position providing a hinge that can swing more closed than if not present. In another embodiment, there is no recessed portion, thereby providing a reduced swing angle in the closed position suitable for a particular purpose.

The extendable multi-axis door hinge 201 further comprises a first gear 52, a second gear 54, and a third gear 56. The first gear 52 is pivotally coupled with the second pivot pin 5 that pivotally couples the first leaf 210 and the second leaf 220. The first gear 52 is rigidly coupled to the second leaf 220 such that when the first gear 52 rotates, the second leaf 220 will pivot about pivot pin 5. In other words, when the second leaf 220 is caused to pivot, the first gear 52 is caused to rotate about the pivot pin 5. The third gear 56 is pivotally coupled with the first pin 3 that pivotally couples the fourth leaf 1000 and the first leaf 210. The third gear 56 is rigidly coupled to the fourth leaf 1000 such that when the third gear 56 rotates, the fourth leaf 1000 will pivot about pivot pin 3. The second gear 54 is in operative engagement with and between both the first gear 52 and the third gear 56 supported by a pivot pin 9 extending from the first leaf 210, such that when the first gear 52 rotates, the third gear 56 rotates in the same direction. When the second leaf end 221 is moved away from the first leaf 210, the first gear 52 drives the second gear 54 which drives the third gear 56 so as to move the first leaf 210 and the second leaf 220 away from the fourth leaf 1000.

Thus, the pivot action of the fourth leaf 1000, first leaf 210, and the second leaf 220 is controlled by the engagement of the first gear 52, second gear 54 and third gear 56. Pivotal movement of the second leaf 220 away from the first leaf 210 causes the first leaf 210 to pivot relative to the fourth leaf 1000 in a controlled predetermined manner, resulting in a substantially lateral movement about a plane orthogonal to the axis of the pivot pin 5.

The relative movement of the first leaf 210, second leaf 220, and fourth leaf 1000 allows a structure coupled to the third leaf 310, such as, but not limited to, a door, to move substantially laterally away from the fourth leaf 1000. This lateral movement allows for more clearance between a structure coupled to the third leaf 310 and a structure coupled to the fourth leaf 1000.

FIG. 2B shows a perspective view of the third leaf 230, in accordance with an embodiment. The third leaf 230 comprises a third leaf first end 231, a third leaf second end 232, a third leaf first side 233, a third leaf second side 234, a third leaf first edge 235, and a third leaf second edge 236 defining a mount plate 239. The third leaf 230 further comprises a lift arm 237, which depends from the third leaf second side 234. The lift arm 237 has a generally goose-neck shape having an arm first end 284 coupled with the third leaf second side 234 and terminating at an arm second end 286. The lift arm 237 comprises an arm first side 281 and an arm second side 283. The arm second end 286 comprises an arm bore 288 extending from the arm first side 281 to the arm second side 283 and having an axis extending substantially perpendicular to the arm first side 281 and the arm second side 283.

The arm bore 288 is adapted to receive the lift hub 274 therein in substantially coaxial alignment therewith. The arm bore 288 defines a second half of the lift bearing 269, shown in FIG. 2A.

The particular shape of the lift arm 237 is chosen suitable for a particular purpose. The goose-neck shape, as shown in FIG. 2B, is suitable to provide, such as, but not limited to, an extension of an attached door 53 so as to clear structures of the vehicle 50 when the multi-axis vehicle door hinge 200 is operated. Other shapes of the lift arm 237 are anticipated suitable for a particular purpose.

Referring also to FIG. 2B, the mount plate 239 of the third leaf 230 is adapted to be coupled to the hinge mount door surface 54 of the door edge 154 using any number of appropriate coupling means known in the art, including, but not limited to, welding, brazing, and mechanical fastening, as will be discussed further below.

FIG. 2B is a perspective view of a lift arm 237 of the multi-axis vehicle door hinge 200 showing the lift arm comprising edge fastener bores for coupling with a lift rotation limiter 440. The arm second end 286 defines an edge 282 having a semi-cylindrical shape having an axis substantially coaxial with the axis of the arm bore 288 and having a radius larger than a radius defined by the arm bore 288. The edge 282 comprises a plurality of spaced-apart edge fastener bores 479 arranged in a radial pattern substantially radial with the axis of the arm bore 288. A plurality of edge fastener bores 479 are adapted to align with corresponding limiter fastener bores as discussed below. The edge fastener bores 479 are threaded for receiving a threaded fastener, such as, but not limited to, a bolt. A lift rotation limiter 440 is adapted to couple with the edge 282 as discussed below.

The lift rotation limiter 440 comprises a partial cylindrical-shaped piece defining an arc having an inner radius R2 substantially the same as an outer radius R1 defined by the edge 282 of the arm second end 286, as shown in FIG. 3. The lift rotation limiter 440 defines an outer radius R3 and a thickness adapted to define an abutment end 442.

Referring again to FIG. 2B, the second leaf 220 further comprises a sag limiter rest 267 which partially defines the second leaf first edge 223 and depends from the second leaf first side 225 adjacent the second leaf first end 221. When coupled to the edge 282, the abutment end 442, is adapted to abut the sag limiter rest 267 at a maximum lift angle .beta. of the lift arm 237.

Figure 5:
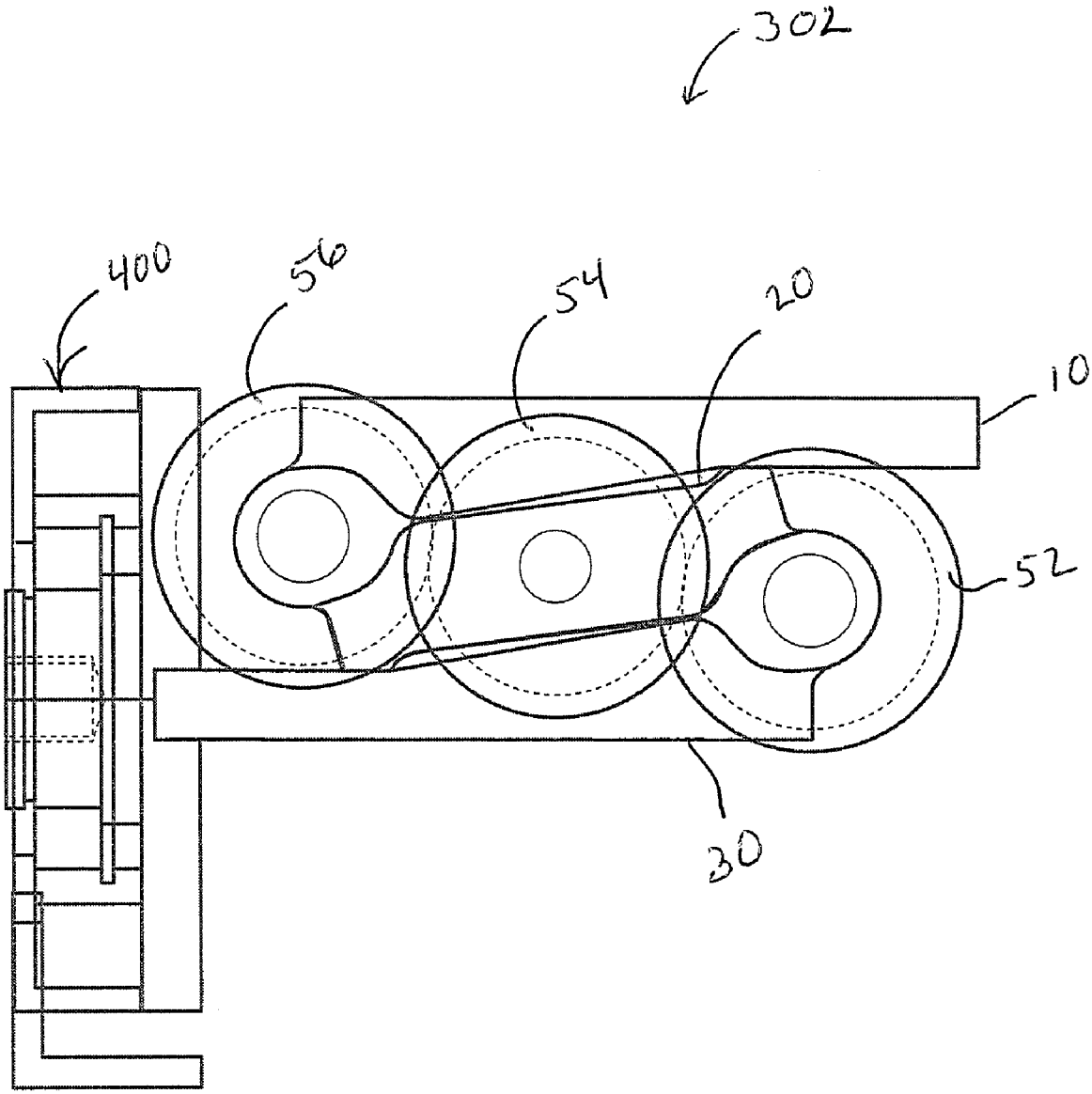
FIG. 5 is a top view of an extendable multi-axis door hinge wherein the first leaf, second leaf and third leaf pivot in a predetermined controlled manner, in accordance with another embodiment.

The lift rotation limiter 440 further comprises a plurality of limiter fastener bores 478 arranged in a radial pattern from the inner radius R2, the pattern in cooperative coaxial arrangement with corresponding edge fastener bores 479. Each limiter fastener bore 478 is adapted to slidingly receive a threaded fastener 462 extending from the outer surface 446 through the inner surface 448. The lift rotation limiter 440 is coupled to the edge 282, as shown in FIGS. 2A and 2B and 5, by one or more threaded fasteners 462 threadably engaged with the edge fastener bore 479, so as to couple the lift rotation limiter 440 to the edge 282 of the arm second end 286. A plurality of edge fastener bores 479 are provided to give the user a choice of location about the circumference of the edge 282 for placement of the lift rotation limiter 440, so as to change the maximum lift angle .beta. of the lift arm 237.

Referring again to FIGS. 2A-2B, the lift rotation limiter 440 limits the maximum extent of rotation, shown as .beta. in FIG. 1B, of the lift arm 237 relative to the second leaf 220 about the lift hub 274. The maximum extent of rotation of the lift arm 237 is selectable by positioning or repositioning the lift rotation limiter 440 adjacent predetermined edge fastener bores 479.

The length of the lift rotation limiter 440 further defines the range of motion and maximum extent of rotation, of the lift arm 237 about the lift hub 274.

Referring also to FIG. 3, it is appreciated that the available range of motion of the multi-axis vehicle door hinge 200 as coupled to a vehicle 50, minimum and maximum extent of rotation about the lift hub 274, and thus, the lift angle .beta., is limited only to the maximum extent in which the door 53 does not collide with the vehicle body 51. The available range of motion of the multi-axis vehicle door hinge 200 about the lift hub 274 itself is limited only to the collision of elements of the third leaf 230 with elements of the second leaf 220, which in the embodiment of FIG. 1B exceeds approximately 270 .degrees.

Referring again to FIGS. 2A and 2B, the multi-axis vehicle door hinge 200 further comprises a cap 270 suitable for coupling the arm second end 286 to the lift hub 274. The cap 270 retains the arm second end 286 to the lift hub 274 by engagement of a fastener 291 passing through a hub through hole 292 in the cap 270 to threadably engage the threaded bore 277 in the lift hub 274.

It is appreciated that there are a plurality of component modifications and changes suitable for a particular purpose. The previous and following specific embodiments highlight various elements that provide various control over the swing and lift of the multi-axis vehicle door hinge. Though these embodiments show elements in specific combinations, it is appreciated that these and other elements can be used singularly and in combination suitable for a particular purpose.

Referring again to FIGS. 2A and 2B, the second leaf 220 further comprises a sag limiter rest 267 which partially defines the second leaf first edge 223 and depends from the second leaf first side 225 adjacent the second leaf first edge 223. The sag limiter rest 267 comprises a threaded bore 266 extending from the second leaf first edge 223 towards the second leaf second edge 224. The threaded bore 266 is adapted to receive a suitable fastener 268, such as but not limited to, a bolt and set screw, so as a portion of the fastener 268 depends beyond the sag limiter rest 267 and towards the second leaf second edge 224.

Referring again to FIG. 2B, the lift arm 237 further comprises an engagement step 265 a predetermined location about the circumference of the arm second end 286. The engagement step 265 depends from the generally circular arm second end 286 a predetermined distance so as to engage the fastener 268 depending from the sag limiter rest 267 when the lift arm 237 is at a predetermined minimum lift angle .beta. to provide adjustability to the minimum lift angle .beta. The engagement and movement of fastener 268 about the threaded bore 266 allows for the adjustment of the fastener 268 to depend from the sag limiter rest 267 a predetermined distance so as to provide adjustability to the minimum lift angle .beta. of the lift arm 237, which is useful in adjusting the level of the door within the door frame of the vehicle. The adjustment of the fastener 268 is easily performed by the user after the multi-axis vehicle door hinge 200, 301 is installed in a vehicle.

Figure 4A:
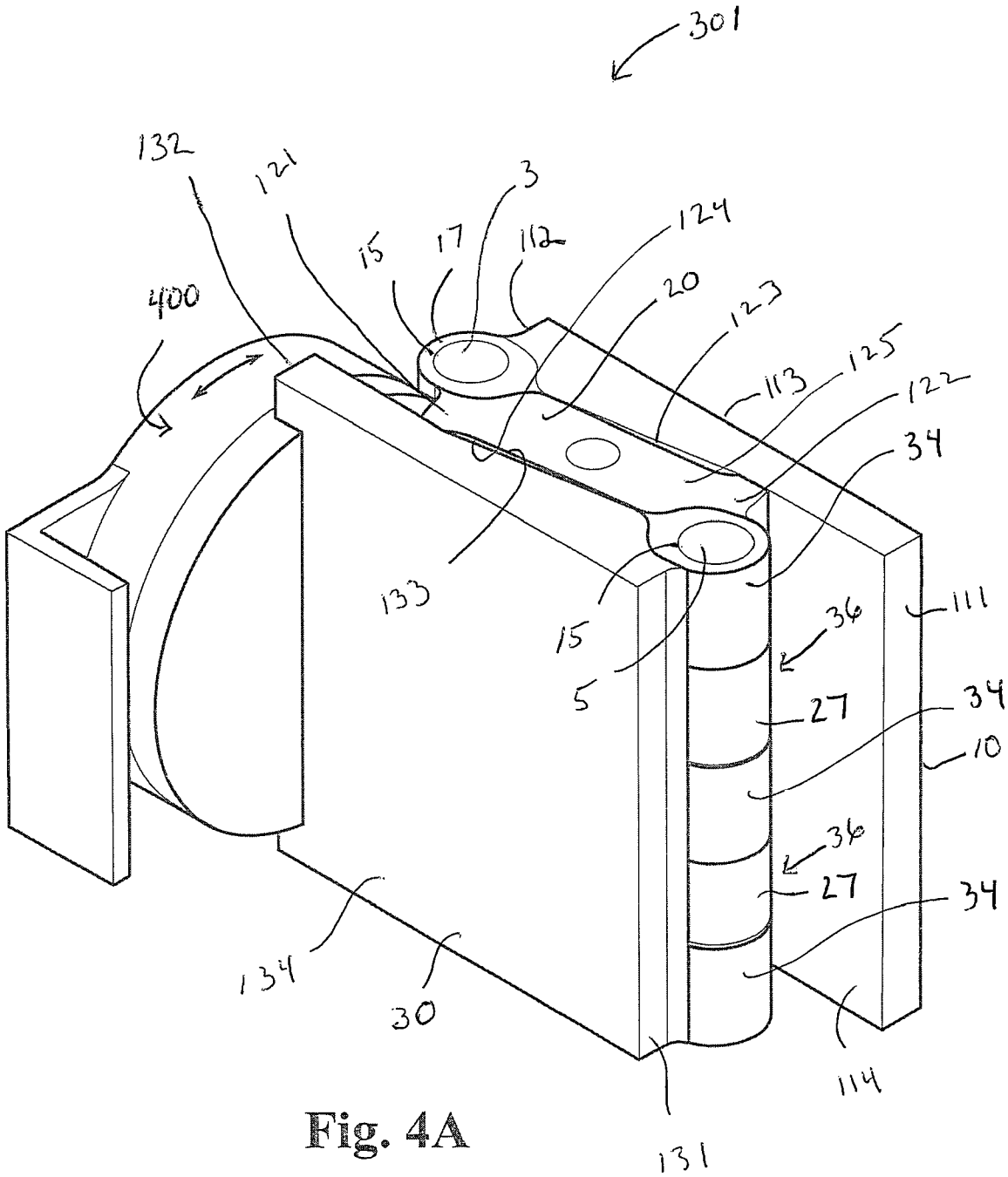
FIG. 4A is a perspective view of an extendable multi-axis door hinge in closed orientation, in accordance with an embodiment.
Figure 4B:
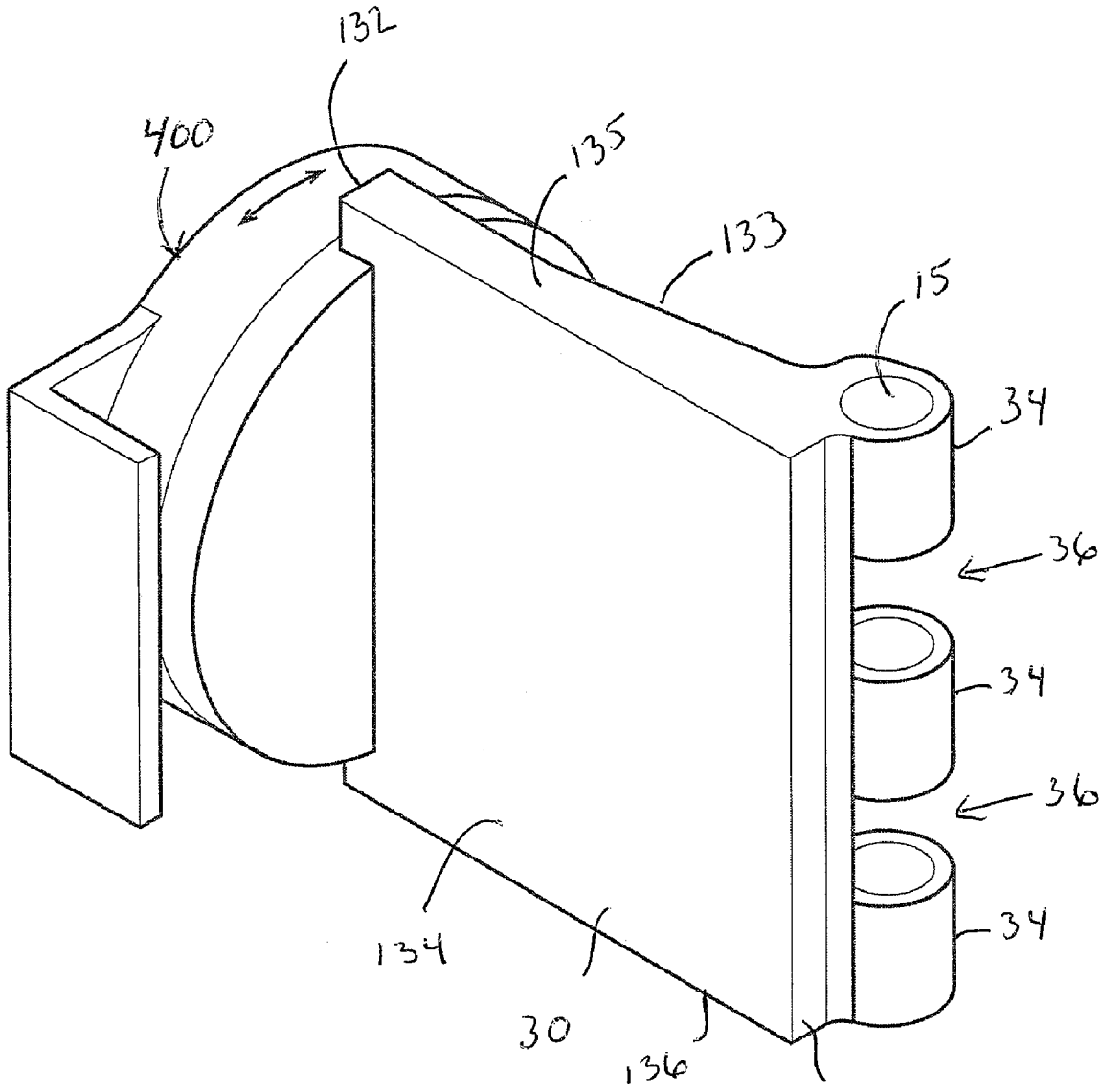
FIG. 4B is a perspective view of the third leaf and the lift hub hinge of the embodiment of FIG. 4A.

FIG. 4A is a perspective view of an extendable multi-axis door hinge 301 in closed orientation, in accordance with an embodiment. The extendable multi-axis door hinge 301 comprises a first leaf 10, second leaf 20, third leaf 30, and lift hub hinge 400. The first leaf 10 is pivotally coupled to the second leaf 20, and the second leaf is pivotally coupled to the third leaf 30, with the lift hub hinge coupled to the third leaf 30. FIG. 4B is a perspective view of the third leaf 30 and the lift hub hinge 400.

The first leaf 10 comprises a first leaf first end 111, a first leaf second end 112 opposite the first leaf first end 111, a first leaf first side 113, and a first leaf second side 114 opposite the first leaf first side 113. Depending from the first leaf second side 114 adjacent the first leaf second end 112 is a plurality of first leaf knuckles 17. The first leaf knuckles 17 have a generally cylindrical shape with a bore 15 there through. The axis of the bore 15 extends substantially parallel to the first leaf second end 112.

The second leaf 20 comprises a second leaf first end 121, a second leaf second end 122 opposite the second leaf first end 121, a second leaf first side 123, a second leaf second side 124 opposite the second leaf first side 123, a second leaf first edge 125, and a second leaf second edge 126 opposite the second leaf first edge 125. A plurality of spaced-apart second leaf first knuckles 24 depend from the second leaf first side 123 adjacent the second leaf first end 121 defining one or more second leaf notches 26 therebetween (not shown). The second leaf first knuckles 24 have a generally cylindrical shape, each with a bore 15 therethrough. The bores 15 are substantially coaxial and extend substantially parallel to the second leaf first end 121. The first leaf knuckles 17 of the first leaf 10 are adapted to be interleaved within the second notches 26 of the second leaf 20 with the axes of the bores 15 in substantially coaxial alignment therewith. A pivot pin 3 extending through the respective bores pivotally couples the first leaf 10 with the second leaf 20.

A plurality of second leaf second knuckles 27 depend from the second leaf second side 124 and adjacent to the second leaf second end 122. The second leaf second knuckles 27 have a generally cylindrical shape with a bore 15 therethrough. The axis of the bore 15 extends substantially parallel with the second leaf second end 122. The second leaf second knuckles 27 of the second leaf 20 are adapted to be interleaved within one or more third leaf notches 36 of the third leaf 30 with the axes of the bores 15 in substantially coaxial alignment, as discussed below.

The third leaf 30 comprises a third leaf first end 131, a third leaf second end 132 opposite the third leaf first end 131, a third leaf first side 133, a third leaf second side 134 opposite the third leaf first side 133, a third leaf first edge 135, and a third leaf second edge 136 opposite the third leaf first edge 135. A plurality of spaced-apart third leaf first knuckles 34 depend from the third leaf first side 133 adjacent the third leaf first end 131 defining one or more third leaf notches 36 therebetween. The third leaf first knuckles 34 have a generally cylindrical shape, each with a bore 15 therethrough. The bores 15 are substantially coaxial and extend substantially parallel to the third leaf first end 131. The second leaf knuckles 27 of the second leaf 20 are adapted to be interleaved within the third leaf notches 36 of the third leaf 30 with the axes of the bores 15 in substantially coaxial alignment therewith. A pivot pin 5 extending through the respective bores pivotally couples the second leaf 20 with the third leaf 30.

The lift hub hinge 400 is coupled to the third leaf 30 about the second end 132. The lift hub hinge 400 provides rotation about an axis that is orthogonal to the pivot axes of pivot pins 3, 5. The lift hub hinge 400 provides function substantially similar to the embodiment of FIGS. 2A and 2B wherein the second leaf 220 and the third leaf 230 are coupled about a lift bearing 269 defining a vertical-lift hinge 203 that provides rotation in a substantially vertical plane about a substantially horizontal axis X of rotation. The multi-axis automobile door hinge 301, therefore, provides rotation in a substantially horizontal plane, noted as swing angle .alpha., and rotation in a substantially vertical plane, noted as lift angle .beta., as well as lateral motion about substantially horizontal plane, separately, and in combination, to suit a particular purpose.

Each leaf comprises knuckles and notches as described above but it is understood that other pivoting structures and combinations may be used for substantially the same purpose.

In the embodiment of FIG. 4A, the first leaf 10, second leaf 20, and third leaf 30 pivot independently in the conventional manner. FIG. 5 is a top view of an extendable multi-axis door hinge 302 wherein the first leaf 10, second leaf 20 and third leaf 30 pivot in a predetermined controlled manner, in accordance with another embodiment. The extendable multi-axis door hinge 301 of FIG. 4A further comprises a first gear 52, a second gear 54, and a third gear 56. The first gear 52 is pivotally coupled with the second pivot pin 5 that pivotally couples the second leaf 20 and the third leaf 30. The first gear 52 is rigidly coupled to the third leaf 30 such that when the first gear 52 rotates, the third leaf 30 will pivot about pivot pin 5. The third gear 56 is pivotally coupled with the first pin 3 that pivotally couples the first leaf 10 and the second leaf 20. The third gear 56 is rigidly coupled to the first leaf 10 such that when the third gear 56 rotates, the first leaf 10 will pivot about pivot pin 3. The second gear 54 is in operative engagement with and between both the first gear 52 and the third gear 56 such that when the first gear 52 rotates, the third gear 56 rotates in the same direction. When the first leaf 10 is moved away from the second leaf 20, the first gear 52 drives the second gear 54 which drives the third gear 56 so as to move the third leaf 30 away from the second leaf 20.

Referring again to FIG. 3, the multi-axis vehicle door hinge 200 is used to couple the door 53 to the vehicle body 51. The fourth leaf 1000 is coupled to the hinge mount body surface 52 of a doorjamb 152 with the swing hinge 202 orientated away from the vehicle body 51 to function as a stationary leaf. The third leaf 230 is coupled to the hinge mount door surface 54 of the door edge 154 with the vertical-lift hinge 203 in an upward orientation to function as a hinge leaf. The second leaf 220 is coupled to the first leaf 210 and the third leaf 230 to allow for swing-out and vertical-lift movement, respectively, as previously described.

It is contemplated that a wide variety of locations may be used as the hinge mount body surface 52 and the hinge mount door surface 54 as being suitable for a particular purpose. For example, but not limited thereto, the hinge mount door surface 54 is a forward door inner surface. In another embodiment, providing pivoting motion from the rear of the door 53, the hinge mount body surface 52 is a rear portion of the doorjamb 152 and the hinge mount door surface 54 is a rear door edge, providing door opening from the front of the door 53 rather than from the rear.

In an application of the multi-axis vehicle door hinge 200, in accordance embodiments, the fourth leaf 1000 is the stationary leaf coupled to a hinge mount body surface 52 of a doorjamb 152 of a vehicle 50 as shown in FIG. 3. The hinge mount body surface 52 may take many forms that are particular to specific models of vehicle 50, and therefore, the fourth leaf 1000 is adapted to facilitate coupling to a specific hinge mount body surface 52 particular to the vehicle 50. The first leaf first side 213 is coupled to the hinge mount body surface 52 using any number of appropriate coupling means known in the art, including, but not limited to, welding, brazing, and mechanical fastening.

In an embodiment, the fourth leaf 1000 is adapted to facilitate the provision of a plurality of bolt holes 37 extending from the first leaf first side 1130 to the fourth leaf second side 1120, such as, but not limited to, those made by the consumer or assembler using a drill. The plurality of bolt holes 37 are located in predetermined locations that correspond to a bolt pattern provided in the hinge mount body surface 52 of the doorjamb 152 of a specific vehicle 50 after the removal of the conventional stock hinge. In another embodiment, the plurality of bolt holes 37 correspond to a new bolt hole pattern provided in the hinge mount body surface 52 of the doorjamb 152 made by the consumer or assembler. One or more bolts (not shown) couple the first leaf 210 to the vehicle 50.

In another embodiment, the fourth leaf 1000 is provided with a plurality of bolt holes 37 in predetermined locations that correspond to a bolt pattern provided in a hinge mount body surface 52 of the doorjamb 152 of one or more specific model of vehicle 50 after the removal of the conventional stock hinge, negating the need for the consumer or assembler to provide the bolt hole pattern in the multi-axis vehicle door hinge 200.

In yet another embodiment, the fourth leaf 1000 is provided with a plurality of elongated bolt holes (not shown) in predetermined locations that correspond to one or more bolt patterns provided in the hinge mount body surface 52 of the doorjamb 152 of one or more specific models of vehicle 50 after the removal of the conventional stock hinge. The elongated bolt holes allow for, among other things, accommodation of mal-aligned bolt hole patterns and applicability across a plurality of models of vehicle.

The specific configuration of the fourth leaf 1000 to permit coupling to a vehicle surface is dependent on a specific vehicle under consideration. Therefore, it is understood that other leaf configurations are anticipated that are adapted to couple to a vehicle's particular body and/or door surface while retaining the mechanical function of a component of a multi-axis vehicle door hinge, as provided herein.

As stated previously, the specific configuration of a fourth leaf 1000 and/or a third leaf 230 to permit coupling to a hinge mount body surface 52 and/or hinge mount door surface 54, respectively, is dependent on the specific vehicle under consideration. Therefore, it is understood that other leaf configurations are anticipated that are adapted to couple to a vehicle's particular body and/or door surface while retaining the mechanical function of the multi-axis vehicle door hinge 200 as provided herein.

Another important consideration, among others, in the retrofitting of conventional swing-out doors with swing-out vertical-lift operation is to provide the ability to adjust or fine tune the operation and alignment of the multi-axis vehicle door hinge. Adjustment and alignment considerations can take many forms, including, but not limited to: strategic placement of the multi-axis vehicle door hinge for proper alt-azimuth location of the vertical and horizontal pivot axis location; means for accommodating misaligned bolt holes; means for adjusting minimum swing-out opening angle $\alpha$ until disengagement of the lift arm 237 and the lift hinge retention element 320; adjustment means for adjusting maximum swing-out opening angle $\alpha$, and adjustment means for adjusting door alignment with the doorjamb.

In an embodiment, means for accommodating misaligned bolt holes between the bolt holes of the fourth leaf 1000 and the hinge mount body surface 52, and the bolt holes 37 of the third leaf 30 and the hinge mount door surface 54, is provided. As discussed previously, in one embodiment, the bolt holes 37 in the fourth leaf 1000 and/or the third leaf 230 are elongated to facilitate alignment with misaligned bolt holes 37 in the hinge mount body surface 52 and/or hinge mount door surface 54. In another embodiment, the elongated bolt holes 37 further provide the ability to adjust and align the angular position of the multi-axis vehicle door hinge with respect to global horizontal and vertical axes.

Figure 6:
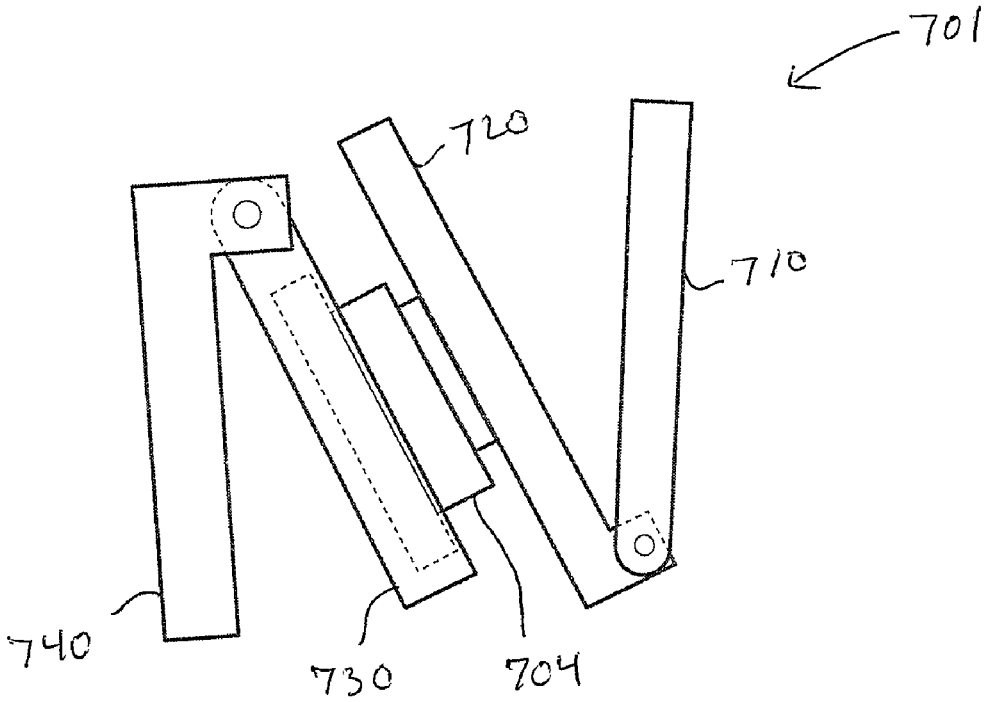
FIG. 6 is a top view of the multi-axis automobile door hinge in accordance with an embodiment.

FIG. 6 is a top view of the multi-axis automobile door hinge 701 in accordance with an embodiment. The extendable multi-axis door hinge 701 comprises a first leaf 710, second leaf 720, third leaf 730 and fourth leaf 740, and an extendable portion in the form of a nesting extension element 704. The first leaf 710 is pivotally coupled to the second leaf 720, and the third leaf 730 is pivotally coupled to the fourth leaf 740. The second leaf 720 and the third leaf 730 are coupled by the nesting extension element 704. The nesting extension element 704 comprises a plurality of nesting segments adapted for telescopic extension. The nesting extension element 704 provides lateral motion between the second leaf 720 and the third leaf 730.

Lateral movement of the second and third leaves allows a structure coupled to the first leaf, such as, but not limited to a door, to move substantially laterally away from a structure coupled to the fourth leaf, such as a door frame, prior to the pivoting of the first leaf and second leaf and/or the third leaf and the fourth leaf. This lateral movement allows for more clearance between the structure coupled to the first leaf and the structure coupled to the fourth leaf.

Figure 7:
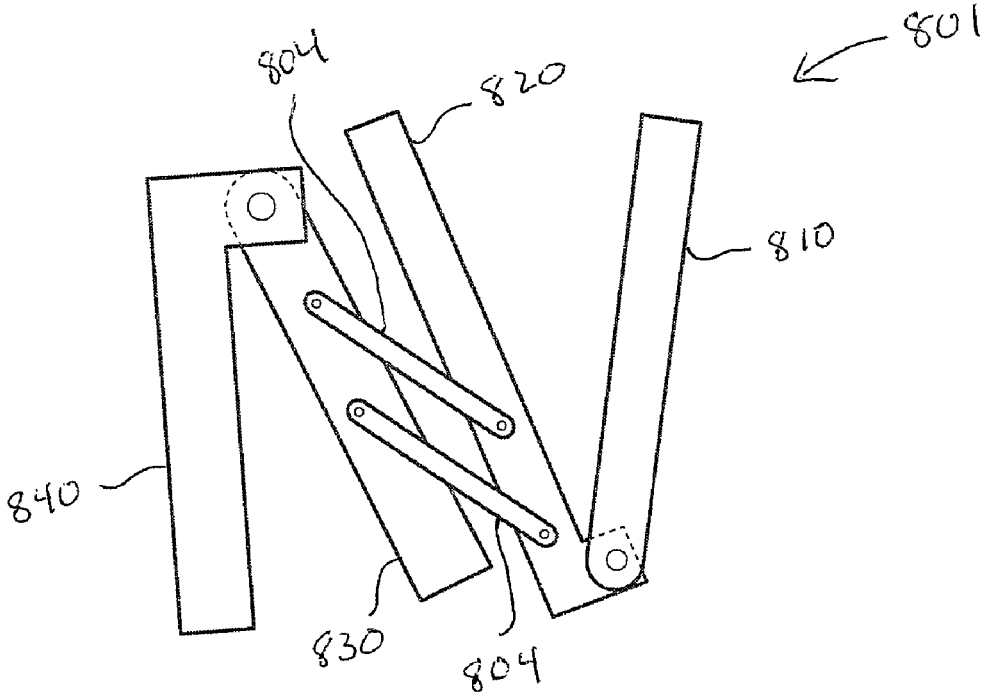
FIG. 7 is a top view of the multi-axis automobile door hinge in accordance with an embodiment.

FIG. 7 is a top view of the multi-axis automobile door hinge 801 in accordance with an embodiment. The extendable multi-axis door hinge 801 comprises a first leaf 810, second leaf 820, third leaf 830 and fourth leaf 840, and an extendable portion in the form of a linkage extension element 804. The first leaf 810 is pivotally coupled to the second leaf 820, and the third leaf 830 is pivotally coupled to the fourth leaf 840. The second leaf 820 and the third leaf 830 are coupled by the linkage extension element 804. The linkage extension element 804 comprises a plurality of linkage segments pivotally coupled to the second leaf 820 and the third leaf 830 adapted for lateral extension. The linkage extension element 804 provides lateral motion between the second leaf 820 and the third leaf 830.

Lateral movement of the second and third leaves allows a structure coupled to the first leaf, such as, but not limited to a door, to move substantially laterally away from a structure coupled to the fourth leaf, such as a door frame, prior to the pivoting of the first leaf and second leaf and/or the third leaf and the fourth leaf. This lateral movement allows for more clearance between the structure coupled to the first leaf and the structure coupled to the fourth leaf.

In other embodiments, the multi-axis vehicle door hinge further comprises torsion control for the vertical lift hinge. Torsion control provides assistance in the operation of the lift arm by providing one or a combination of: return bias for returning the lift arm to the down position; retaining, counterbalancing or equilibrating the lift arm in any position between down and up when released by the user; and biasing the lift arm in the maximum up position. Embodiments of the multi-axis vehicle door hinge further comprise torsion control in the forms of springs, gas struts, and linear actuators, wherein the linear actuators can provide for powered operation.

Embodiments of the extendable multi-axis vehicle door hinge retain the conventional swing-out operating characteristics associated with the initial opening and final closing movement of the door, and enabling the ability to accommodate many door shapes for vertical-lift operation. Retaining the initial swing-out of the door provides that no modification to the stock latching and closing mechanism is required. Further, the integrity of the stock door sealing and weather stripping system is not compromised.

The initial swing-out of the door 53 provides that all door structures will clear the vehicle body 51 as the door 53 is vertically-lifted, shown in FIG. 3. This permits the incorporation of vertical door operation for vehicles with doors that have structures that would collide with the vehicle body 51 if the door 53 were to be opened using a single-axis vertical-lift hinge. Such door structures include, but are not limited to, an undercut bottom door edge that wraps inwardly under the vehicle body 51 that would collide with the doorjamb 152.

Embodiments of a vertical-lift door system provides the assembler or consumer an integrated system of one or more hinges and lift assist devices to provide the operating characteristics of a swing-out, lateral motion, vertical-lift door. The lift assist devices provide for, singularly or in combination, among other things, controlled and deliberate movement of the door, power-assisted door operation, and easier integration and assembly onto vehicles during assembly as well as stock vehicles for retrofit applications.

Embodiments of the multi-axis vehicle door hinge provide the ability to make available swing-out, lateral motion, vertical-lift door operation not only to vehicle manufacturers, but also to the vehicle enthusiast who desires to convert a vehicle from swing-out door operation to vertical-lift operation with a minimum amount of modification to the vehicle.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A hinge comprising:

a first leaf;

a second leaf;

a third leaf; and a lift hub hinge, the first leaf pivotally coupled to the second leaf, and the second leaf pivotally coupled to the third leaf, the lift hub hinge coupled to the third leaf, the first leaf comprising a first leaf first end, a first leaf second end opposite the first leaf first end, a first leaf first side, and a first leaf second side opposite the first leaf first side, a plurality of first leaf knuckles depending from the first leaf second side adjacent the first leaf second end, the first leaf knuckles have a generally cylindrical shape including a bore therethrough having an axis substantially parallel to the first leaf second end;

the second leaf comprising a second leaf first end, a second leaf second end opposite the second leaf first end, a second leaf first side, a second leaf second side opposite the second leaf first side, a second leaf first edge, and a second leaf second edge opposite the second leaf first edge, a plurality of spaced-apart second leaf first knuckles depend from the second leaf first side adjacent the second leaf first end defining one or more second leaf notches therebetween, the second leaf first knuckles having a generally cylindrical shape, each with a bore therethrough having an axis substantially coaxial and substantially parallel to the second leaf first end, the first leaf knuckles of the first leaf operable to be interleaved within the second notches of the second leaf with the axes of the bores in substantially coaxial alignment therewith; a first pivot pin extending through the respective bores pivotally coupling the first leaf with the second leaf, a plurality of second leaf second knuckles depending from the second leaf second side and adjacent to the second leaf second end, the second leaf second knuckles having a generally cylindrical shape with a bore therethrough having an axis substantially parallel with the second leaf second end, the second leaf second knuckles of the second leaf operable to be interleaved within one or more third leaf notches of the third leaf with the axes of the bores in substantially coaxial alignment;

the third leaf comprising a third leaf first end, a third leaf second end opposite the third leaf first end, a third leaf first side, a third leaf second side opposite the third leaf first side, a third leaf first edge, and a third leaf second edge opposite the third leaf first edge, a plurality of spaced-apart third leaf first knuckles depend from the third leaf first side adjacent the third leaf first end defining one or more third leaf notches therebetween, the third leaf first knuckles having a generally cylindrical shape, each with a bore therethrough having an axis substantially coaxial and substantially parallel to the third leaf first end, the second leaf knuckles of the second leaf operable to be interleaved within the third leaf notches of the third leaf with the axes of the bores in substantially coaxial alignment therewith, a second pivot pin extending through the respective bores pivotally coupling the second leaf with the third leaf, the lift hub hinge coupled to the third leaf about the second end, the lift hub hinge operable to provide rotation about an axis that is orthogonal to the pivot axes of pivot pins, the hinge further comprising a first gear;

a second gear; and a third gear, the first gear pivotally coupled with the second pivot pin, the first gear rigidly coupled to the third leaf, the third gear pivotally coupled with the first pivot pin, the third gear rigidly coupled to the first leaf, the second gear in operative engagement with the first gear and the third gear such that when the first gear rotates, the third gear rotates in the same direction, and wherein the first leaf is moved away from the second leaf, the first gear drives the second gear which drives the third gear so as to move the third leaf away from the second leaf.

2. The hinge of claim 1, wherein the first leaf is operable for coupling to a hinge mount body surface of a door jamb of a vehicle, and the lift hub hinge is operable for coupling to a hinge mount door surface of a door.

3. A hinge comprising:

a first leaf;

a second leaf;

a third leaf; and a lift hub hinge coupled to the third leaf, the first leaf pivotally coupled to the second leaf, the second leaf pivotally coupled to the third leaf, the first leaf, second leaf and third leaf provide a combination of lateral and pivoting motion about a first axis, the lift hub providing a rotation about a plane substantially orthogonal to the first axis, the first leaf comprising a first leaf first end, a first leaf second end opposite the first leaf first end, a first leaf first side, and a first leaf second side opposite the first leaf first side, a plurality of first leaf knuckles depending from the first leaf second side adjacent the first leaf second end, the first leaf knuckles have a generally cylindrical shape including a bore therethrough having an axis substantially parallel to the first leaf second end;

the second leaf comprising a second leaf first end, a second leaf second end opposite the second leaf first end, a second leaf first side, a second leaf second side opposite the second leaf first side, a second leaf first edge, and a second leaf second edge opposite the second leaf first edge, a plurality of spaced-apart second leaf first knuckles depend from the second leaf first side adjacent the second leaf first end defining one or more second leaf notches therebetween, the second leaf first knuckles having a generally cylindrical shape, each with a bore therethrough having an axis substantially coaxial and substantially parallel to the second leaf first end, the first leaf knuckles of the first leaf operable to be interleaved within the second notches of the second leaf with the axes of the bores in substantially coaxial alignment therewith; a first pivot pin extending through the respective bores pivotally coupling the first leaf with the second leaf, a plurality of second leaf second knuckles depending from the second leaf second side and adjacent to the second leaf second end, the second leaf second knuckles having a generally cylindrical shape with a bore therethrough having an axis substantially parallel with the second leaf second end, the second leaf second knuckles of the second leaf operable to be interleaved within one or more third leaf notches of the third leaf with the axes of the bores in substantially coaxial alignment;

the third leaf comprising a third leaf first end, a third leaf second end opposite the third leaf first end, a third leaf first side, a third leaf second side opposite the third leaf first side, a third leaf first edge, and a third leaf second edge opposite the third leaf first edge, a plurality of spaced-apart third leaf first knuckles depend from the third leaf first side adjacent the third leaf first end defining one or more third leaf notches therebetween, the third leaf first knuckles having a generally cylindrical shape, each with a bore therethrough having an axis substantially coaxial and substantially parallel to the third leaf first end, the second leaf knuckles of the second leaf operable to be interleaved within the third leaf notches of the third leaf with the axes of the bores in substantially coaxial alignment therewith, a second pivot pin extending through the respective bores pivotally coupling the second leaf with the third leaf, the lift hub hinge coupled to the third leaf about the second end, the lift hub hinge operable to provide rotation about an axis that is orthogonal to the pivot axes of pivot pins, the hinge further comprising a first gear;

a second gear; and a third gear, the first gear pivotally coupled with the second pivot pin, the first gear rigidly coupled to the third leaf, the third gear pivotally coupled with the first pivot pin, the third gear rigidly coupled to the first leaf, the second gear in operative engagement with the first gear and the third gear such that when the first gear rotates, the third gear rotates in the same direction, and wherein the first leaf is moved away from the second leaf, the first gear drives the second gear which drives the third gear so as to move the third leaf away from the second leaf.

4. The hinge of claim 3, wherein the first leaf is operable for coupling to a hinge mount body surface of a door jamb of a vehicle, and the lift hub hinge is operable for coupling to a hinge mount door surface of a door.

* * * * *